US008983098B2

(12) United States Patent
Norris

(10) Patent No.: US 8,983,098 B2
(45) Date of Patent: Mar. 17, 2015

(54) SUBSTANTIALLY PLANATE PARAMETRIC EMITTER AND ASSOCIATED METHODS

(71) Applicant: Parametric Sound Corporation, Poway, CA (US)

(72) Inventor: Elwood G. Norris, Poway, CA (US)

(73) Assignee: Turtle Beach Corporation, Poway, CA (US)

( * ) Notice: Subject to any disclaimer, the term of this patent is extended or adjusted under 35 U.S.C. 154(b) by 0 days.

(21) Appl. No.: 13/801,718

(22) Filed: Mar. 13, 2013

(65) Prior Publication Data

US 2014/0161282 A1 Jun. 12, 2014

Related U.S. Application Data

(60) Provisional application No. 61/682,959, filed on Aug. 14, 2012.

(51) Int. Cl.

| | |
|---|---|
| ***H04R 7/04*** | (2006.01) |
| *H04R 7/18* | (2006.01) |
| *H04R 17/00* | (2006.01) |

(52) U.S. Cl.

CPC .. *H04R 7/04* (2013.01); *H04R 7/18* (2013.01); *H04R 17/00* (2013.01); *H04R 2217/03* (2013.01); *H04R 2307/023* (2013.01); *H04R 2307/025* (2013.01)

USPC ..... 381/190; 381/152; 381/423

(58) Field of Classification Search

CPC .... H04R 2217/03; H04R 7/045; H04R 17/00; H04R 2201/021; H04R 1/403; H04R 7/04; H04R 5/02

USPC ..... 381/77, 79, 82, 111, 114, 116, 152, 381/162, 173, 190, 191, 398, 399, 423, 381/431; 310/324, 328, 334

See application file for complete search history.

(56) References Cited

U.S. PATENT DOCUMENTS

| | | | | |
|---|---|---|---|---|
| 5,889,870 | A * | 3/1999 | Norris | 381/77 |
| 6,108,433 | A * | 8/2000 | Norris | 381/399 |
| 6,229,899 | B1 * | 5/2001 | Norris et al. | 381/77 |
| 6,278,787 | B1 | 8/2001 | Azima | |
| 6,372,066 | B1 | 4/2002 | Bream | |
| 6,546,106 | B2 | 4/2003 | Azima | |
| 6,606,389 | B1 * | 8/2003 | Selfridge et al. | 381/111 |
| 6,606,390 | B2 | 8/2003 | Azima | |
| 6,865,277 | B2 | 3/2005 | Bank et al. | |
| 6,871,149 | B2 | 3/2005 | Sullivan et al. | |
| 6,885,753 | B2 | 4/2005 | Bank | |
| 6,922,642 | B2 | 7/2005 | Sullivan | |
| 6,925,187 | B2 * | 8/2005 | Norris et al. | 381/191 |
| 6,965,678 | B2 | 11/2005 | Bank | |
| 7,149,318 | B2 | 12/2006 | Bank et al. | |
| 7,151,837 | B2 | 12/2006 | Bank et al. | |
| 7,157,649 | B2 | 1/2007 | Hill | |

(Continued)

FOREIGN PATENT DOCUMENTS

| | | |
|---|---|---|
| WO | WO 97 09842 | 3/1997 |

*Primary Examiner* — Huyen D Le

(57) ABSTRACT

A parametric speaker comprises a generally planate radiating element, suitable for radiating ultrasonic vibrations into a fluid medium, and an emitter, having an ultrasonic output and/or resonant frequency, the emitter being intimately coupled to the radiating element. The radiating element is physically configured to have a mechanical resonance that substantially matches the output and/or resonant frequency of the emitter.

19 Claims, 3 Drawing Sheets

(56) References Cited

U.S. PATENT DOCUMENTS

| | | | |
|---|---|---|---|
| 7,184,898 | B2 | 2/2007 | Sullivan et al. |
| 7,376,523 | B2 | 5/2008 | Sullivan et al. |
| 7,635,941 | B2 | 12/2009 | Bank et al. |
| 7,684,576 | B2 | 3/2010 | Bank et al. |
| 2005/0100181 | A1 | 5/2005 | Croft |

* cited by examiner

SUBSTANTIALLY PLANATE PARAMETRIC EMITTER AND ASSOCIATED METHODS

PRIORITY CLAIM

Priority is claimed to U.S. Provisional Patent Application Ser. No. 61/682,959, filed Aug. 14, 2012, which is hereby incorporated herein by reference in its entirety.

BACKGROUND OF THE INVENTION

1. Field of the Invention

The present invention relates generally to the field of parametric loudspeakers and signal processing systems for use in audio reproduction. More particularly, the present invention relates to parametric emitters formed of substantially rigid plates or generally planate emitter structures.

2. Related Art

Non-linear transduction, such as a parametric array in air, results from the introduction of sufficiently intense, audio modulated ultrasonic signals into an air column. Self demodulation, or down-conversion, occurs along the air column resulting in the production of an audible acoustic signal. This process occurs because of the known physical principle that when two sufficiently intense sound waves with different frequencies are radiated simultaneously in the same medium, a modulated waveform including the sum and difference of the two frequencies is produced by the non-linear (parametric) interaction of the two sound waves. When the two original sound waves are ultrasonic waves and the difference between them is selected to be an audio frequency, an audible sound can be generated by the parametric interaction. Emitters suitable for producing such an effect are referred to herein as "parametric emitters."

While the theory of non-linear transduction has been addressed in numerous publications, commercial attempts to capitalize on this intriguing phenomenon have largely failed. Most of the basic concepts integral to such technology, while relatively easy to implement and demonstrate in laboratory conditions, do not lend themselves to applications where relatively high volume outputs are necessary. As the technologies characteristic of the prior art have been applied to commercial or industrial applications requiring high (or even useful) volume levels, distortion of the parametrically produced sound output has resulted in inadequate systems.

Whether the emitter is a piezoelectric emitter or PVDF film, in order to achieve volume levels of useful magnitude, conventional systems often require that the emitter be driven at intense levels. These intense levels have been often greater than the physical limitations of the emitter device, resulting in high levels of distortion or high rates of emitter failure, or both, and without achieving the magnitude required for many commercial applications.

SUMMARY OF THE INVENTION

In accordance with one aspect of the invention, a parametric speaker is provided, including a generally planate radiating element, suitable for radiating ultrasonic vibrations into a nonlinear medium. An emitter, having an output frequency in the ultrasonic audio range, can be intimately coupled to the radiating element. The radiating element is physically configured to have a mechanical resonance that substantially matches the output frequency of the emitter.

In accordance with another aspect of the invention, a parametric speaker is provided, including a generally planate radiating element, suitable for radiating ultrasonic vibrations into a nonlinear medium. An emitter, having an output frequency in the ultrasonic audio range, can be intimately coupled to the radiating element. The radiating element can be physically configured to have a mechanical resonance that substantially matches the output frequency of the emitter. A mechanical stiffening system can serve to alter a mechanical resonance of the radiating element to substantially match or correspond to the output frequency of the emitter.

In accordance with another aspect of the invention, a method of forming a parametric speaker is provided, including: obtaining a generally planate radiating element; intimately bonding an emitter to the radiating element, the emitter having an ultrasonic output frequency; physically altering the radiating element such that it exhibits a mechanical resonance that substantially matches the resonant frequency of the emitter, if the radiating element does not already exhibit a mechanical resonance that substantially matches the resonant frequency of the emitter; and electronically coupling to the emitter a signal processing system suitable for delivering to the emitter an ultrasonic signal having an audio signal modulated thereon.

In accordance with another aspect of the invention, a method of providing an audible audio signal is provided, including: obtaining a generally planate radiating element having an emitter intimately bonded thereto, the radiating element having a mechanical resonance that substantially matches a resonant, ultrasonic frequency of the emitter; and providing to the emitter an ultrasonic signal modulated by an audio signal to cause the radiating element to radiate the modulated ultrasonic signal to thereby cause an audible difference signal being produced in a fluid medium adjacent the radiating element.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
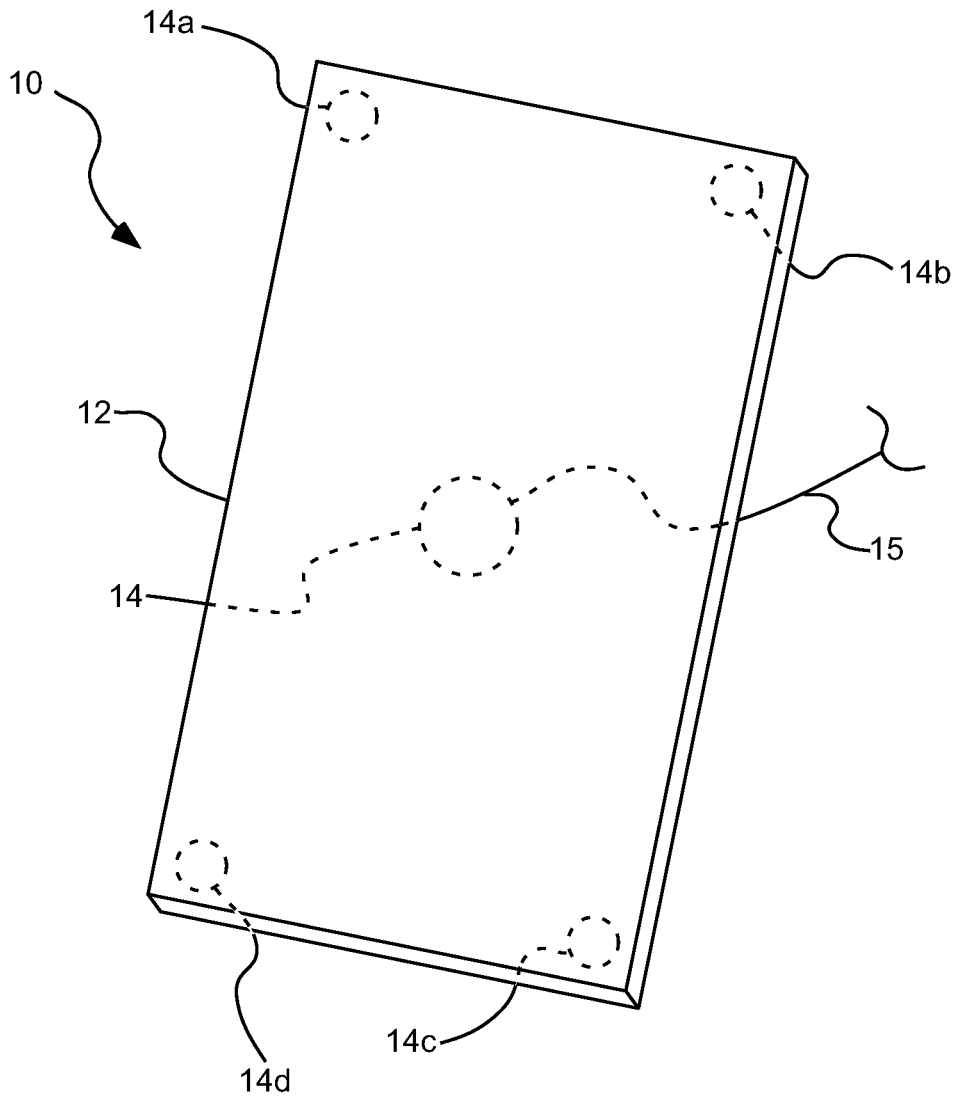
FIG. 1 is a perspective view of an exemplary speaker arrangement in accordance with an embodiment of the invention.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" can include plural referents, unless the context clearly dictates otherwise. Thus, for example, reference to an "emitter" can include reference to one or more of such emitters.

DEFINITIONS

In describing and claiming the present invention, the following terminology will be used in accordance with the definitions set forth below.

As used herein, the term "planate" radiating element is to be understood to refer to a radiating element that is generally planar in nature, but that can vary in a number of manners from a strictly planar object. For example, radiating elements can be substantially flat, rectangular or square elements which include a generally much greater width and height than a thickness. Planate radiating elements can also be curvilinear in nature, for example, they may appear similar in shape to arcuate sections of cylindrical or spherical bodies. Planate radiating elements can include relatively flat surfaces, or they can include ridged, ribbed, textured, or surfaces that otherwise deviate from completely flat.

Relative directional terms, such as "upper," "lower," "top," bottom," etc., are used herein to aid in describing various features of the present system. It is to be understood that such terms are generally used in a manner consistent with the understanding one of ordinary skill in the art would have of such systems. Such terms should not, however, be construed to limit the present invention.

As used herein, the term "substantially" refers to the complete, or nearly complete, extent or degree of an action, characteristic, property, state, structure, item, or result. As an arbitrary example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As another arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

Distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value and should apply regardless of the breadth of the range or the characteristics being described.

Invention

The present invention relates generally to speaker systems that utilize planate radiating elements to generate parametric audio in a fluid medium adjacent the radiating elements. Once such exemplary arrangement is illustrated in FIG. 1. In this embodiment, the speaker 10 can include a generally planate radiating member 12, which can be suitable for radiating ultrasonic vibrations into a fluid medium adjacent the radiating element (e.g., air or other gas or liquid adjacent the unit). The system can include an emitter 14 that can be predesigned to have an output frequency (and, in some embodiments, a resonant frequency) that is in the ultrasonic audio range. The emitter can be intimately coupled to the radiating element in a variety of manners, as will be discussed in further detail below. Typically, the radiating element is physically configured to have a mechanical resonance that substantially matches the output or resonant frequency of the emitter.

Generally speaking, a signal processing system (one example of which is discussed below in relation to FIGS. 5-6) can be electronically coupled to the emitter 14 via input 15. The signal processing system will be suitable to deliver to the emitter an ultrasonic signal (carrier wave) onto which is modulated an audio signal that will be reproduced parametrically in the fluid (e.g., air) adjacent the planate radiator.

For a more detailed explanation of the process by which parametric sound is produced, the reader is directed to numerous patents issued to the present inventor, including U.S. Pat. Nos. 5,889,870 and 6,229,899, which are incorporated herein by reference to the extent that they are consistent with the teachings herein. Due to numerous subsequent developments made by the present inventor, these earlier works are to be construed as subordinate to the present disclosure in the case any discrepancies arise therebetween.

All of such prior work in the parametric field to date has focused on various manners of improving the emission of ultrasonic signals by various film transducers, piezoelectric transducers, etc., into air or a similar fluid to create audible sound. In contrast, however, the emitter 14 of the present invention is not used to emit pressure waves into a fluid medium. Instead, the emitter is intimately bonded to the radiating member 12 and the ultrasonic signal is transmitted into the radiating member. The radiating member, which can have a mechanical resonance tuned to substantially match the output frequency, and/or the resonant frequency, of the emitter, then radiates pressure waves into the fluid medium adjacent the radiating element. Radiation of the pressure waves by the radiating element results in creation of an audible signal in the fluid medium. Notably, in most cases neither the radiating element nor the emitter produce signals which are audible by the human ear.

The radiating element can be mechanically "tuned" in a variety of manners so as to exhibit a mechanical resonance that substantially matches the output frequency and/or the resonant frequency of the emitter. The mechanical resonance of the radiating element can be influenced by a number of factors, including, without limitation, material selection, geometry of the radiating element (e.g., thickness, width, height, etc.), surface treatment of the radiating element (e.g., ribbed or otherwise textured surface applied thereto), physically restraining or tensioning the radiating element, etc.

Figure 2:
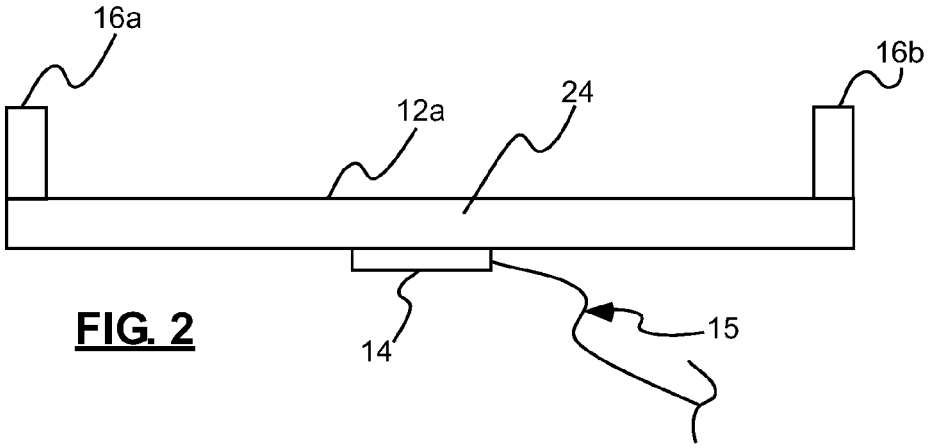
FIG. 2 is a schematic end view of an exemplary speaker system arrangement in accordance with an embodiment of the invention.

In some embodiments, the radiating element can include a body portion (e.g., 24, 26 in FIGS. 2 and 3, respectively) and some manner of mechanical stiffening system or mechanism. For example, in the embodiment illustrated in FIG. 2, the radiator 12*a* includes a base 24 and a pair of stiffening members 16*a*, 16*b* coupled to edges of the base to increase a stiffness of the base (and thereby increase the mechanical resonant frequency of the radiator to more closely match that of the emitter). While FIG. 2 shows the stiffening members coupled to or atop side edges of the base, in other embodiments the stiffening members can be coupled along all sides (including the ends) of the base. The stiffening members can themselves be selected from differing materials, and differing thicknesses, widths, etc. to achieve the desired tuning of the radiating element.

Figure 3:
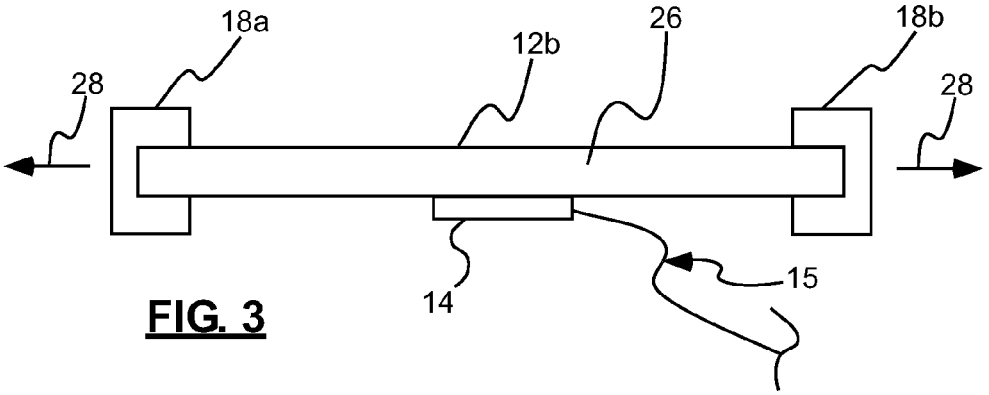
FIG. 3 is a schematic end view of an exemplary speaker system arrangement in accordance with another embodiment of the invention.

In the example shown in FIG. 3, radiating element 12*b* can include base 26 to which members 18*a* and 18*b* are coupled. Members 18*a*, 18*b* can serve as stiffening members in and of themselves, or can serve as elements by which tension can be applied to the base 26. For example, clamps or similar grasping mechanisms can engage members 18*a*, 18*b* and apply tension by applying force to the members in the directions shown by indicators 28. Depending upon the embodiment, the radiating element 12*b* can either be fixed in this tensioned state after tensioning (and the mechanical stiffening system can be removed), or it can be held in the tensioned state by the mechanical stiffening system during operation.

In one embodiment of the invention, the radiating element can be at least partially translucent or transparent. For example, in one embodiment the radiating element can be formed of a material such a relatively clear polymer or a ceramic glass. In this manner, the radiating element can be used as a component of a device in which visual information is provided to a user through the radiating element. For example, computer display screens, ATM display screens, cell phone screens, etc., can all be provided with a radiating element that is clear enough to allow the user to view visual information presented by the device, while at the same time the radiating element provides highly directional audio information to the user.

In one specific embodiment, the radiating element is formed at least partially of an alumino silicate glass. One such material that has been found to be effective is a product sold under the tradename Gorilla Glass. Such a glass is not only very transparent, but is strong and scratch resistant and has the ability to withstand a relatively high degree of tensioning. Thus, in the event the size of the glass selected for a desired application does not possess the desired mechanical resonance, it can be mechanically tuned (e.g., tensioned) until it does.

In other embodiment, the radiating element can be formed from a generally sheet-like metallic material, or a variety of polymeric materials, as would be appreciated by one of ordinary skill in the art having possession of this disclosure.

The emitter 14 can be of a variety of types. Suitable examples include, without limitation, piezoelectric emitters, magnetostrictive emitters, and the like. Generally speaking, the emitter must be capable of creating vibrations in the radiating element 12 and so must, typically, include some moveable component that is capable of doing so.

As shown in FIG. 1, the emitter can be positioned adjacent the radiating element in a number of places. In one aspect of the invention, a single emitter 14 can be intimately bonded to the radiating element near a center of the radiating element, so as to evenly send vibrations through the entire radiating element. In other embodiments, a plurality of emitters, e.g., 14*a*, 14*b*, 14*c*, 14*d*, etc., can be positioned at strategic locations across a surface of the radiating element. Various emitter and radiating element pairings will dictate which relationship is optimal to result in the radiating element radiating the desired ultrasonic pressure waves. Also, in some embodiments, some degree of transparency or translucence may be desired in the radiating element. In such cases, it can be desirable to vary the location of the emitter or emitters used so as to not interfere with the visual effect desired by the emitter system as a whole (e.g., if the radiating element is used as a cell phone "glass," it may be advantageous to position the emitters out of line of sight of most or all of the input functions in the glass.

The emitter can be intimately bonded to the radiating element in a number of manners. Suitable ways of bonding the emitter to the radiator include, without limitation, use of adhesives, adhesive tapes, ultrasonic welding (where materials allow), and the like. The choice of which bonding technique (and bonding material) to utilize will often depend upon the type of emitter selected and the material (and surface finish) of the radiating element. It will typically be desired, however, to reduce or limit as much as possible any impedance between the emitter and the bonding material and the radiating element, so as to lose as little power from the signal as is possible.

Figure 4:
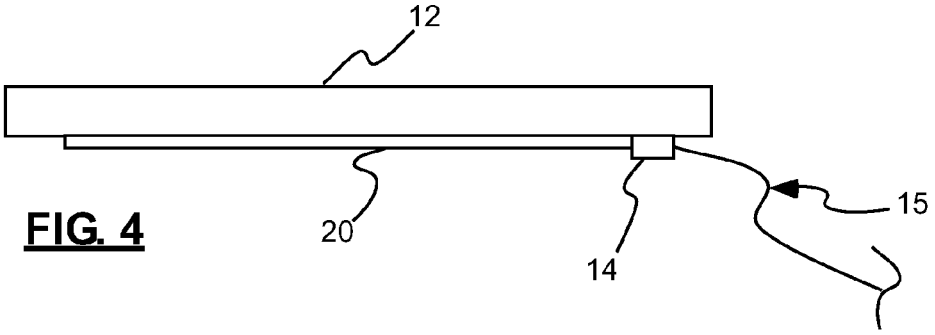
FIG. 4 is a schematic end view of an exemplary speaker system arrangement in accordance with another embodiment of the invention.

As shown in FIG. 4, in one aspect of the invention, the speaker can include a sensing system 20 disposed adjacent the radiating element 12. The sensing system can be operable to sense contact with the radiating element by a user to allow the user to input data through the sensing system. This aspect of the invention can be particularly advantageous for use in devices such as PDAs, cell phones, computer screens, and the like. In this manner, the radiating element can simultaneously serve three purposes: it can provide highly directional audio information to the user; it can provide visual information to the user; and it can provide a method by which the user can input data into the device with which the radiating element is associated. The sensing system 20 can be selected from a variety of such systems known by those of ordinary skill in such arts.

In addition to the various devices discussed above, the present invention also provides various methods for arranging, manufacturing or using speakers. These include, without limitation, a method of forming a parametric speaker, including the steps of obtaining a generally planate radiating element and intimately bonding an emitter to the radiating element. The emitter can have an ultrasonic output and/or resonant frequency. The method can include physically altering the radiating element such that it exhibits a mechanical resonance that substantially matches the output and/or resonant frequency of the emitter, if the radiating element does not already exhibit a mechanical resonance that substantially matches the output and/or resonant frequency of the emitter. A signal processing system can be electronically coupled to the emitter that is suitable for delivering to the emitter a modulated ultrasonic signal carrying an audio signal thereon.

In accordance with another aspect of the invention, a method of providing an audible audio signal is provided, including the steps of obtaining a generally planate radiating element having an emitter intimately bonded thereto, the radiating element having a mechanical resonance that substantially matches an output and/or resonant, ultrasonic frequency of the emitter. An ultrasonic signal having an audible signal modulated thereon can be applied to the emitter to cause the radiating element to radiate the modulated ultrasonic signal to thereby cause an audible difference signal to be produced in a fluid medium adjacent the radiating element.

Figure 5:
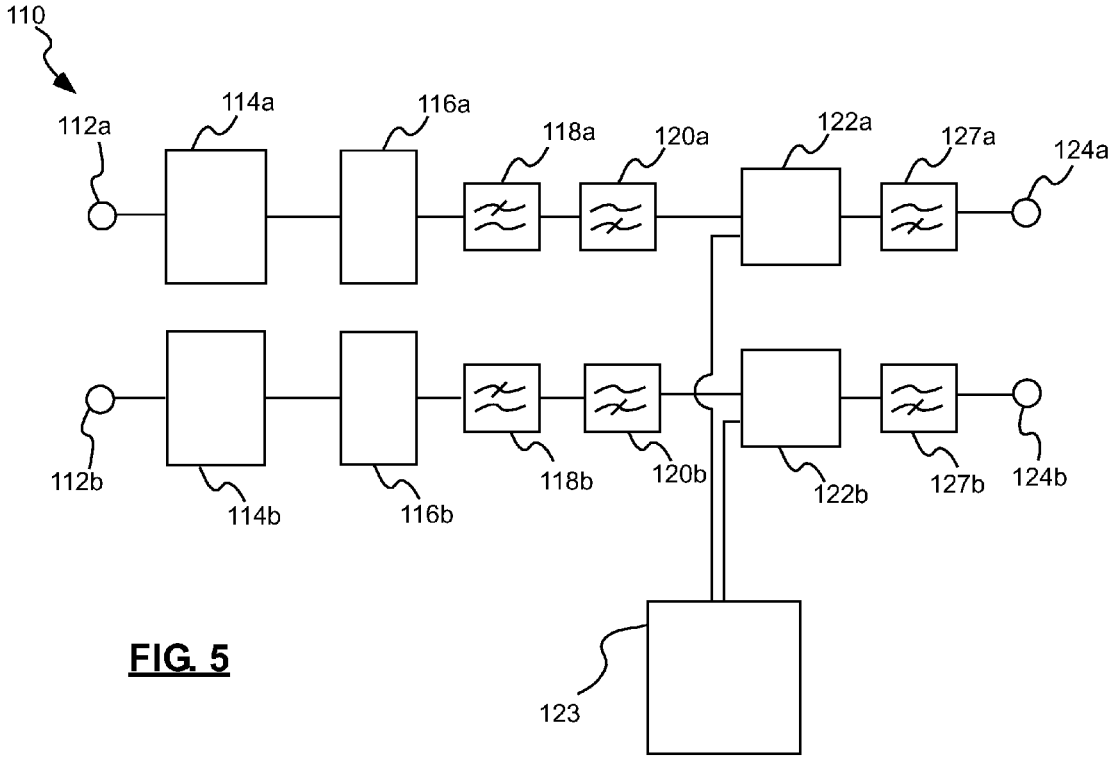
FIG. 5 is a block diagram of an exemplary signal processing system in accordance with one embodiment of the invention.
Figure 6:
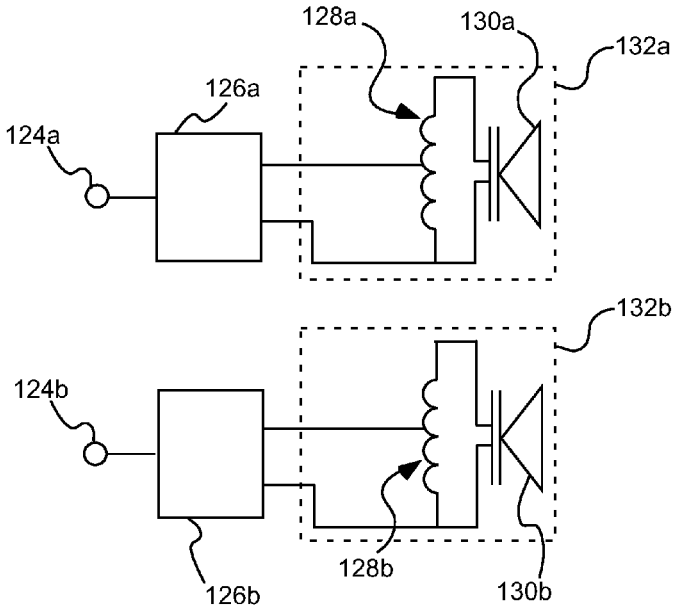
FIG. 6 is a block diagram of an exemplary amplifier and emitter arrangement in accordance with an embodiment of the invention.

One an exemplary, non-limiting signal processing system that can be utilized with the present system is illustrated schematically in FIGS. 5 and 6. In this embodiment, various processing circuits or components are illustrated in the order (relative to the processing path of the signal) in which they are arranged according to one implementation of the invention. It is to be understood that the components of the processing circuit can vary, as can the order in which the input signal is processed by each circuit or component. Also, depending upon the embodiment, the processing system 110 can include more or fewer components or circuits than those shown.

Also, the example shown in FIG. 5 is optimized for use in processing multiple input and output channels (e.g., a "stereo" signal), with various components or circuits including substantially matching components for each channel of the signal. It is to be understood that the system can be equally effectively implemented on a single signal channel (e.g., a "mono" signal), in which case a single channel of components or circuits may be used in place of the multiple channels shown.

Referring now to the exemplary embodiment shown in FIG. 5, a multiple channel signal processing system 110 can include audio inputs that can correspond to left 112*a* and right 112*b* channels of an audio input signal. Compressor circuits 114*a*, 114*b* can compress the dynamic range of the incoming signal, effectively raising the amplitude of certain portions of the incoming signals and lowering the amplitude of certain other portions of the incoming signals resulting in a narrower range of emitted amplitudes. In one aspect, the compressors lessen the peak-to-peak amplitude of the input signals by a ratio of not less than about 2:1. Adjusting the input signals to a narrower range of amplitude is important to minimize distortion which is characteristic of the limited dynamic range of this class of modulation systems.

After the audio signals are compressed, equalizing networks 116*a*, 116*b* can provide equalization of the signal. The equalization networks can advantageously boost lower frequencies to increase the benefit provided naturally by the emitter/inductor combination of the parametric emitter assembly 132*a*, 132*b* (FIG. 6).

Low pass filter circuits 118*a*, 118*b* can be utilized to provide a hard cutoff of high portions of the signal, with high pass filter circuits 120*a*, 120*b* providing a hard cutoff of low portions of the audio signals. In one exemplarily embodiment of the present invention, low pass filters 118*a*, 118*b* are used to cut signals higher than 15 kHz, and high pass filters 120*a*, 120*b* are used to cut signals lower than 200 Hz (these cutoff points are exemplary and based on a system utilizing an emitter having on the order of 50 square inches of emitter face).

The high pass filters 120*a*, 120*b* can advantageously cut low frequencies that, after modulation, result in nominal deviation of carrier frequency. These low frequencies are very difficult for the system to reproduce efficiently (as a result, much energy can be wasted trying to reproduce these frequencies), and attempting to reproduce them can greatly stress the emitter(s) or radiating element.

The low pass filter can advantageously cut higher frequencies that, after modulation, could result in the creation of an audible beat signal with the carrier. By way of example, if a low pass filter cuts frequencies above 15 kHz, with a carrier frequency of around 44 kHz, the difference signal will not be lower than around 29 kHz, which is still outside of the audible range for humans. However, if frequencies as high as 25 kHz were allowed to pass the filter circuit, the difference signal generated could be in the range of 19 kHz, which is well within the range of human hearing.

In the exemplary embodiment shown, after passing through the low pass and high pass filters, the audio signals are modulated by modulators 122*a* and 122*b*, where they are combined with a carrier signal generated by oscillator 123. While not so required, in one aspect of the invention, a single oscillator (which in one embodiment is driven at a selected frequency of 40 kHz to 50 kHz, which range corresponds to readily available crystals that can be used in the oscillator) is used to drive both modulators 122*a*, 122*b*. By utilizing a single oscillator for multiple modulators, an identical carrier frequency is provided to multiple channels being output at 124*a*, 124*b* from the modulators. This aspect of the invention can negate the generation of any audible beat frequencies that might otherwise appear between the channels while at the same time reducing overall component count.

While not so required, in one aspect of the invention, high-pass filters 127*a*, 127*b* can be included after modulation that serve to filter out signals below about 25 kHz. In this manner, the system can ensure that no audible frequencies enter the amplifier via outputs 124*a*, 124*b*. In this manner, only the modulated carrier wave is fed to the amplifier(s), with any audio artifacts being removed prior to the signal being fed to the amplifier(s).

Thus, the signal processing system 10 receives audio input at 112*a*, 112*b* and processes these signals prior to feeding them to modulators 122*a*, 122*b*. An oscillating signal is provided at 123, with the resultant outputs at 124*a*, 124*b* then including both a carrier (typically ultrasonic) wave and the audio signals that are being reproduced, typically modulated onto the carrier wave. The resulting signal(s), once emitted in a non-linear medium such as air, produce highly directional parametric sound within the non-linear medium.

For more background on the basic technology behind the creation of an audible wave via the emission of two ultrasonic waves, the reader is directed to numerous patents previously issued to the present inventor, including U.S. Pat. Nos. 5,889,870 and 6,229,899, which are incorporated herein by reference to the extent that they are consistent with the teachings herein. Due to numerous subsequent developments made by the present inventor, these earlier works are to be construed as subordinate to the present disclosure in the case any discrepancies arise therebetween.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

I claim:

1. A parametric speaker, comprising:

a substantially rigid, planate radiating element, suitable for radiating ultrasonic vibrations into a nonlinear medium, the planate radiating element comprising a continuous sheet of material devoid of openings;

an emitter, having an output frequency that is in the ultrasonic audio range, the emitter being intimately coupled in direct contact with the radiating element; and a signal processing system, electronically coupled to the emitter, the signal processing system operable to deliver to the emitter a modulated ultrasonic signal; wherein the radiating element is physically configured to have a mechanical resonance that substantially matches the output frequency of the emitter.

2. The speaker of claim 1, wherein the radiating element includes a body and a mechanical stiffening system, the mechanical stiffening system serving to alter a mechanical resonance of the body.

3. The speaker of claim 1, wherein the radiating element is formed at least partially of a ceramic glass.

4. The speaker of claim 3, wherein the ceramic glass comprises an alumino silicate glass.

5. The speaker of claim 3, further comprising a mechanical stiffening system coupled to the ceramic glass, the mechanical stiffening system serving to place at least a portion of the glass into a tensioned state in order to alter a mechanical resonance of the glass.

6. The speaker of claim 1, wherein the radiating element is formed of a continuous sheet of metallic material.

7. The speaker of claim 1, wherein the radiating element is formed of a continuous sheet of polymeric material.

8. The speaker of claim 1, wherein the emitter comprises a piezoelectric emitter.

9. The speaker of claim 1, wherein the emitter comprises a magnetostrictive emitter.

10. The speaker of claim 1, wherein the radiating element is at least partially translucent or transparent.

11. The speaker of claim 10, further comprising a sensing system, disposed adjacent the radiating element, the sensing system operable to sense contact with the radiating element by a user to allow the user to input data through the radiating element.

12. The speaker of claim 1, wherein the output frequency of the emitter is restricted to a narrow frequency range.

13. The speaker of claim 1, wherein only the planate radiating element emits ultrasonic vibrations into the nonlinear medium.

14. The speaker of claim 1, wherein the planate radiating element is substantially flat.

15. The speaker of claim 1, wherein the planate radiating element is devoid of protrusions.

16. The speaker of claim 1, wherein the planate radiating element is substantially flat and devoid of protrusions.

17. A parametric speaker, comprising:

a substantially rigid, planate radiating element, suitable for radiating ultrasonic vibrations into a nonlinear medium, the planate radiating element comprising a continuous sheet of material devoid of openings;

an emitter, having an output and/or resonant frequency that is in the ultrasonic audio range, the emitter being intimately coupled in direct contact with the radiating element;

a signal processing system, electronically coupled to the emitter, the signal processing system operable to deliver to the emitter a modulated ultrasonic signal;

the radiating element being physically configured to have a mechanical resonance that substantially matches the output frequency of the emitter; and a mechanical stiffening system, the mechanical stiffening system serving to alter a mechanical resonance of the radiating element.

18. A method of forming a parametric speaker, comprising:

obtaining a substantially rigid, planate radiating element, the planate radiating element comprising a continuous sheet of material devoid of openings;

intimately bonding an emitter in direct contact with the radiating element, the emitter having an ultrasonic output and/or resonant frequency;

physically altering the radiating element such that it exhibits a mechanical resonance that substantially matches the output and/or resonant frequency of the emitter, if the radiating element does not already exhibit a mechanical resonance that substantially matches the emitter frequency; and electronically coupling to the emitter a signal processing system suitable for delivering to the emitter an ultrasonic signal having an audio signal modulated thereon.

19. A method of providing an audible audio signal, comprising:

obtaining a substantially rigid planate radiating element comprising a continuous sheet of material devoid of openings, the radiating element having an emitter intimately bonded thereto in direct contact therewith, the radiating element having a mechanical resonance that substantially matches an output and/or resonant, ultrasonic frequency of the emitter;

providing to the emitter an ultrasonic signal modulated by an audio signal to cause the radiating element to radiate the modulated ultrasonic signal to thereby cause an audible difference signal being produced in a fluid medium adjacent the radiating element.

* * * * *